US006540083B2

(12) United States Patent
Shih

(10) Patent No.: US 6,540,083 B2
(45) Date of Patent: Apr. 1, 2003

(54) COSMETIC CONTAINER

(75) Inventor: Yu-Ching Shih, Yung Kung (TW)

(73) Assignee: Hawthorn Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 09/866,614

(22) Filed: May 30, 2001

(65) Prior Publication Data

US 2002/0179485 A1 Dec. 5, 2002

(51) Int. Cl.[7] ..... A45D 33/00

(52) U.S. Cl. ..... 206/581; 132/294; 206/457; 224/604

(58) Field of Search ..... 132/294–297; 206/235, 581, 823, 457; 220/4.26, 4.27, 23.8; 224/603, 604

(56) References Cited

U.S. PATENT DOCUMENTS 3,188,157 A * 6/1965 Rand ..... 220/23.8
3,392,868 A * 7/1968 Pfrommer ..... 220/4.27
3,441,033 A * 4/1969 Flax ..... 132/295
4,155,477 A * 5/1979 Fosher ..... 220/4.27
4,807,773 A * 2/1989 Tasi ..... 220/4.27
5,259,502 A * 11/1993 Chan ..... 220/4.27
6,145,515 A * 11/2000 Wu ..... 132/295
6,302,120 B1 * 1/2001 Kuo ..... 132/295
6,223,921 B1 * 5/2001 Huang ..... 220/4.27

* cited by examiner

*Primary Examiner*—Jim Foster
(74) *Attorney, Agent, or Firm*—Rosenberg, Klein & Lee

(57) ABSTRACT

A cosmetic container includes a lower cap, an inner container and an upper cap. The lower cap and the upper cap are firmly combined together with a front post and a rear post of the lower cap respectively mating with the upper cap. A space is formed between the upper and the lower caps for the inner container to be positioned therein when not in use. The inner container is pushed and swung out of the space for using cosmetics stored in chambers formed in an upper portion of the inner container and a mirror is fixed in a lower portion of the inner container.

3 Claims, 5 Drawing Sheets

COSMETIC CONTAINER

BACKGROUND OF THE INVENTION

This invention relates to a cosmetic container, particularly to one having a small size convenient to carry along and a simple structure to assemble.

A known conventional cosmetic container 4 shown in FIGS. 5, 6 and 7 includes a housing 41, an inner container 42 as main components combined together. The housing 41 is made integral by injecting shooting process, having an upper sidewall 411, a lower sidewall 412 and a vertical connecting wall 413 connecting a rear end of both the upper and the lower sidewall 411 and 412. Then, the upper, the lower sidewall 411, 412 and the vertical connecting wall 413 form a hollow interior 414. Further, the upper sidewall 411 has an upper through hole 415 and the lower sidewall 412 has a lower through hole 416 aligned to the upper through hole 415.

The inner container 42 has an upper stud 421 and a lower stud 422 formed on and under an inner sidewall to fit in the upper through hole 415 and the lower through hole 416, an outer sidewall 423 for pulling out the inner container 42, and a plurality of hollow chambers 425 separated by separating walls 424 (as shown in FIG. 6) and surrounded an circumferential wall for storing a plurality of cosmetics therein.

Normally when the cosmetics stored in the conventional cosmetic container is not used, the inner container 42 is kept between in the hollow interior 414 of the housing 41. In case of using the cosmetics for makeup, a user pulls the outer sidewall 423 of the inner container 42 and swings the inner container 42 out of the housing 41 with the upper and the lower stud 421 and 422 as pivots. Then the cosmetics stored in the hollow chambers 425 may appear for the user to use as shown in FIG. 7.

However, the conventional cosmetic container has the following disadvantages.

1. A mold for making the housing 41 consisting of the upper sidewall 411, the lower sidewall 412 and the vertical sidewall 413 is complicated to result in a high cost.
2. The housing 41 and the inner container 42 are combined together with the studs 421, 422 engaging the upper and the lower hole 415, 416, and if the studs 421, 422 are too long, they can hardly engaging in the holes 415, 416 smoothly, but if the studs 421, 422 are too short, the inner container 42 may be liable to separate from the housing 41. In addition, the housing 41 might be damaged if the force is too large to push the inner container in combining.
3. Its outer appearance is monotonous, devoid of aesthetic value, almost impossible to arouse buying desire of consumers. Or even a buyer may be tired of it after a short period of use.

SUMMARY OF THE INVENTION

The main objective of the invention is to offer a cosmetic container consisting of an upper cap, a lower cap, and an inner container positioned in a space between the upper and the lower cap and possible to be swing out of the upper cap by means of front post of the lower cap engaging a front through holes of the inner container. Another objective of the invention is to offer a cosmetic container having the inner container divided in an upper portion and a lower portion, with the upper portion having a plurality of hollow chambers separated by separating walls for storing various cosmetics, and with the lower portion having a mirror fitted on its surface.

Another objective of the invention is to offer a cosmetic container having the upper cap and the lower cap shaped as a kind of insect, or animal for increasing beauty of the cosmetic container to excite buying desire of consumers.

One more objective of the invention is to offer a cosmetic container having the front post of the lower cap bored with a center hole for a necklace to pass through to hang the cosmetic container on the neck of a user.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
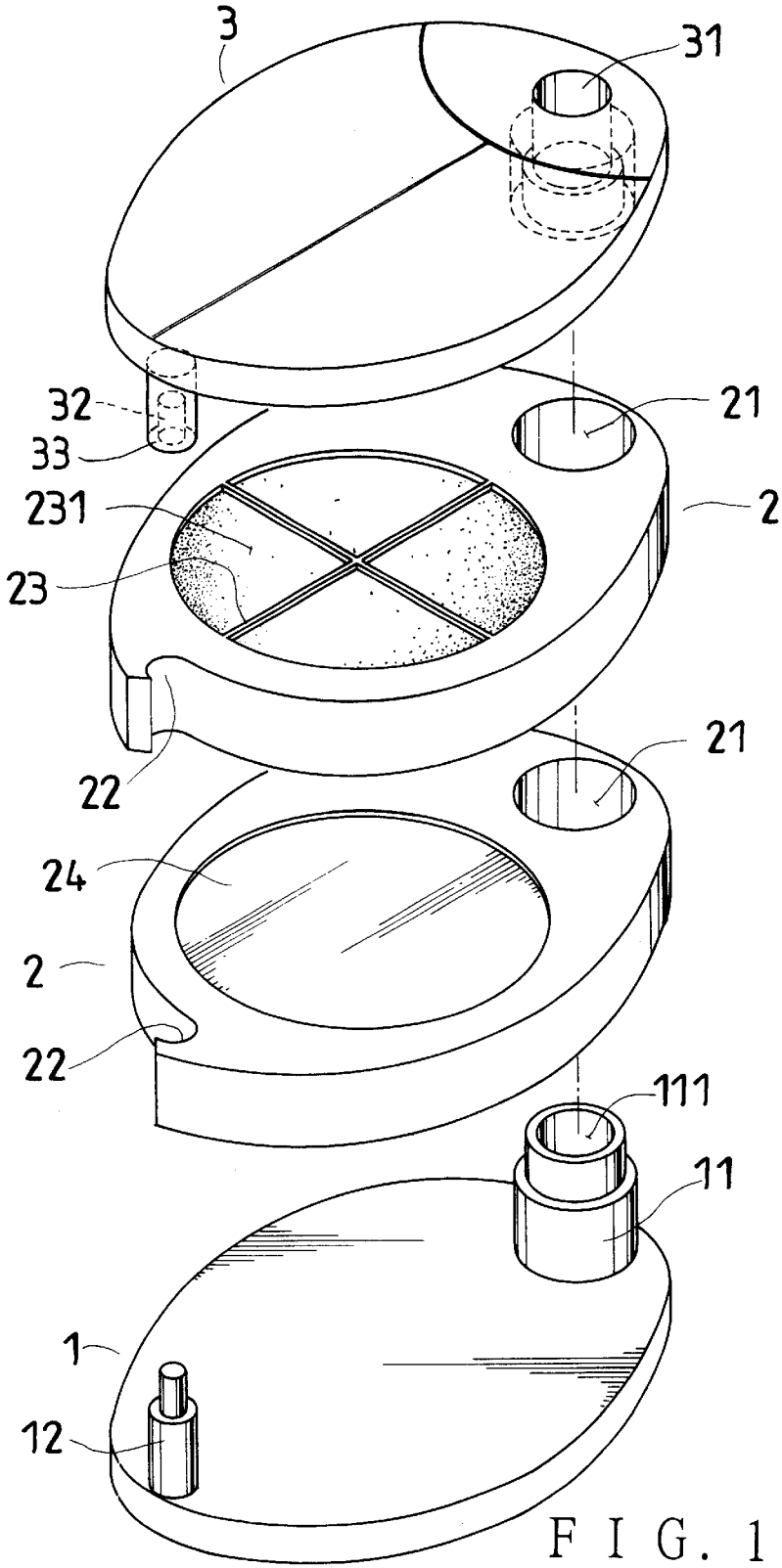
FIG. 1 is an exploded perspective of a cosmetic container of the present invention.

A preferred embodiment of a cosmetic container in the present invention, as shown in FIG. 1, includes a lower cap 1, an inner container 2 and an upper cap 3 as main components combined together.

The lower cap 1 has a two-stage front post 11 fixed upright on a front end of an upper surface and having a center through hole 111, and a two-stage rear post 12 fixed upright on a rear end of the upper surface. Further the two-stage front post 11 and the two-stage rear post 12 all have an upper smaller stage than a lower stage.

The inner container 2 is divided in an upper portion and a lower portion, having a through hole 21 in a front end of both the upper and the lower portion, a C-shaped engage groove 22 formed in a rear end of both the upper and the lower portion. The upper portion has a plurality of hollow chambers 231 separated by separating walls 23, and the lower portion has a recess 24 for inserting firmly a mirror therein as shown in FIG. 2.

The upper cap 3 has the same shape and size as the lower cap 1, possible to have a beautiful pattern on an upper surface or a shape of an insect or an animal. The upper cap 3 further has a front hole 31 aligned to the front post 11 of the lower cap 1 and fitted in by the upper stage of the front post 11, and a downwardly extending post 33 having a rear hole formed therein aligned with the upper stage of the rear post 12 of the lower cap 1 and receiving the upper stage of the rear post 12 therein.

Figure 2:
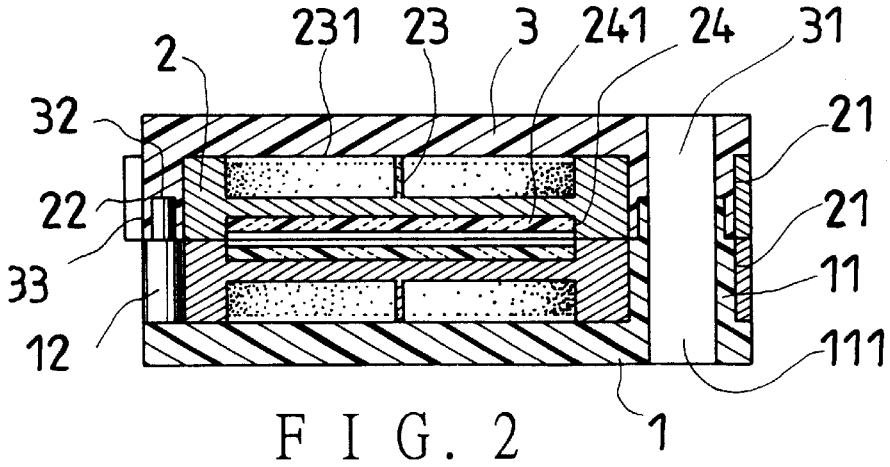
FIG. 2 is a side cross-sectional view of the cosmetic container of the present invention.
Figure 4:
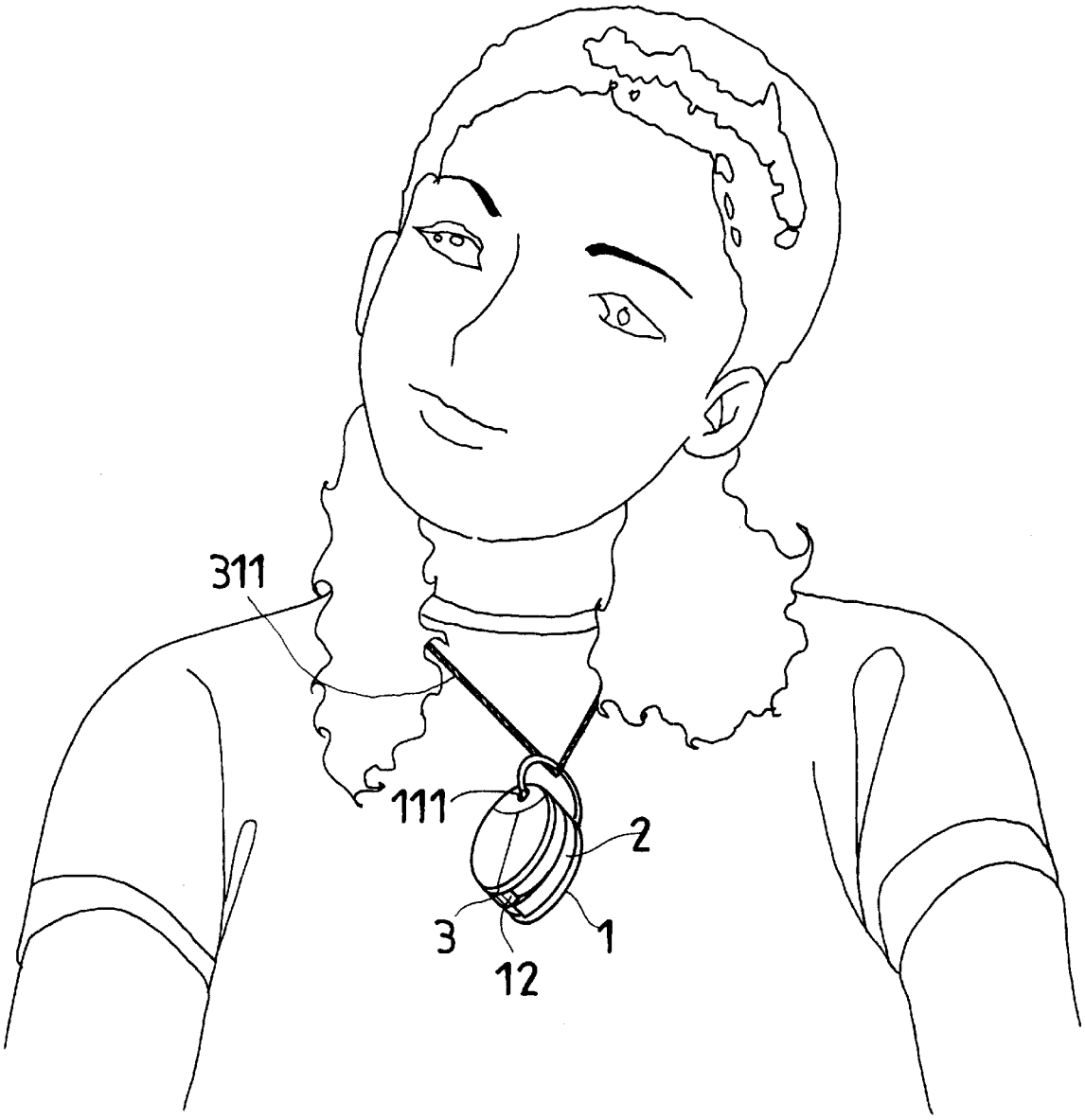
FIG. 4 is a perspective view of the cosmetic container hung on the neck of a user of the present invention.
Figure 5:
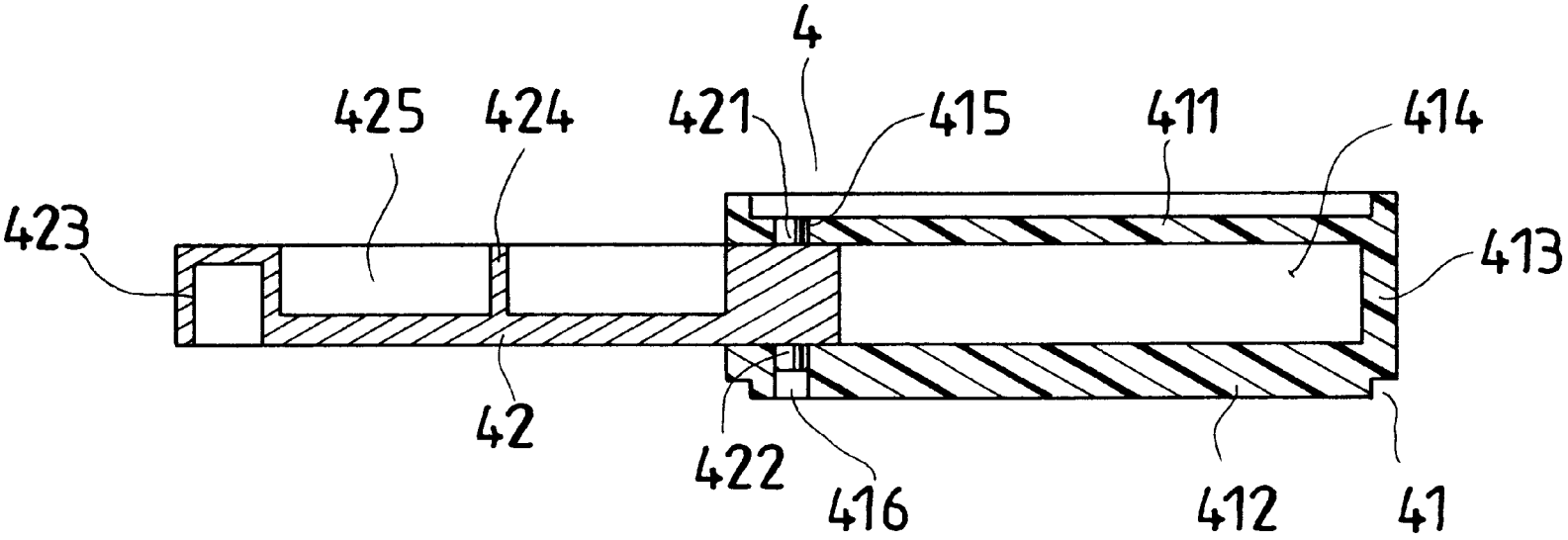
FIG. 5 (PRIOR ART)
FIG. 5 is a side cross-sectional view of a known conventional cosmetic container.
Figure 7:
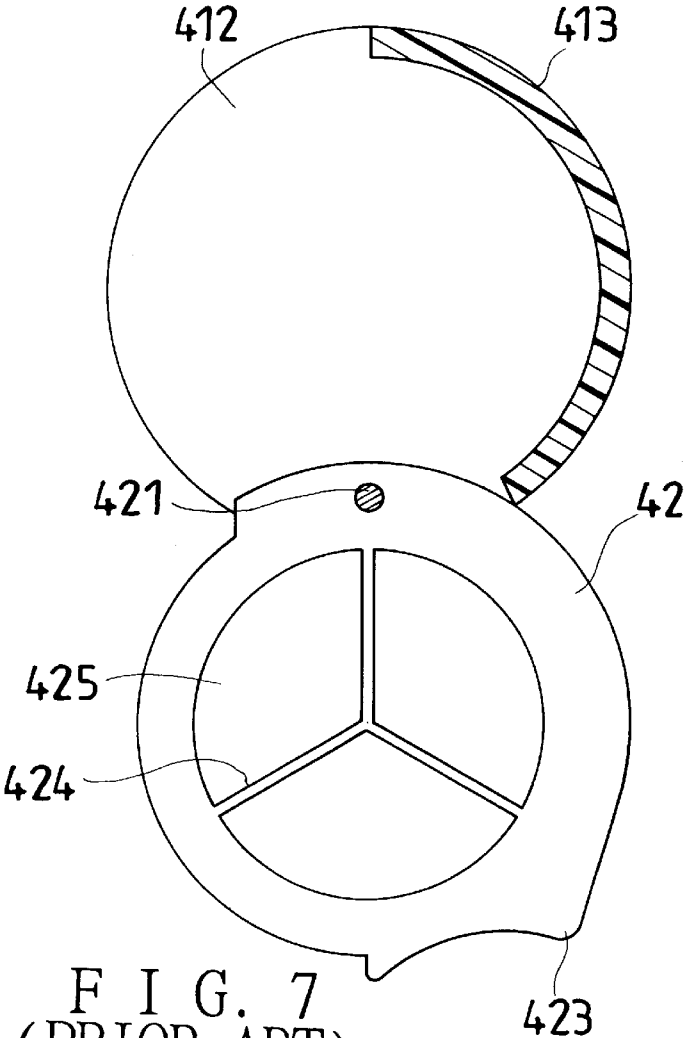
FIG. 7 (PRIOR ART)
FIG. 7 is an upper view of the known conventional cosmetic container in the opened condition.
Figure 6:
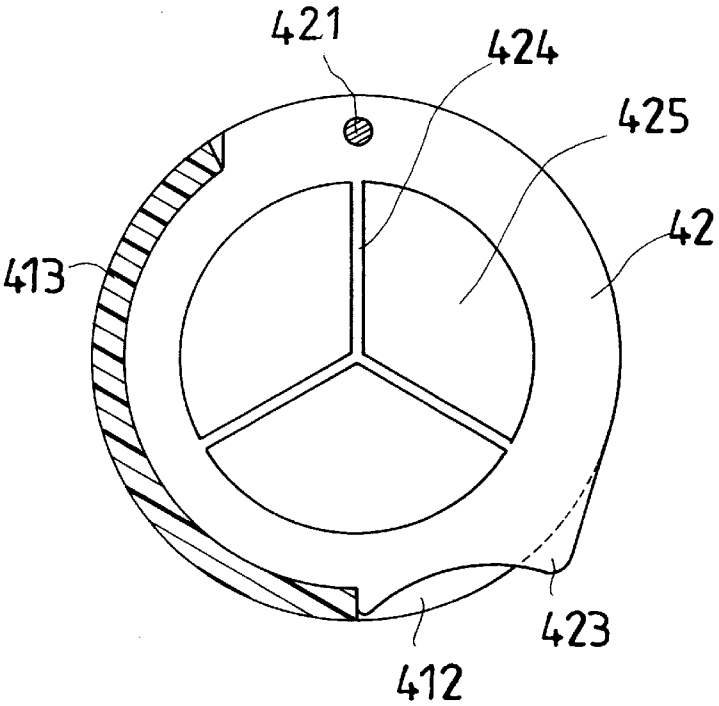
FIG. 6 (PRIOR ART)
FIG. 6 is an upper view of the known convention cosmetic container in the closed condition.

In assembling the cosmetic container, as shown in FIG. 2, first the two-stage front post 11 of the lower cap 1 is inserted through the front through holes 21 of the inner container 2 and then in the front hole 31 of the upper cap 3 firmly. Then the rear post of the lower cap 1 fits firmly in the rear hole 32 of the post 33 of the upper cap, with the C-shaped engage groove 22 of the upper portion engaging with the post 33 of the upper cap 3, and the engage groove 22 of the lower portion engaging the rear post 12 of the lower cap 1.

Figure 3:
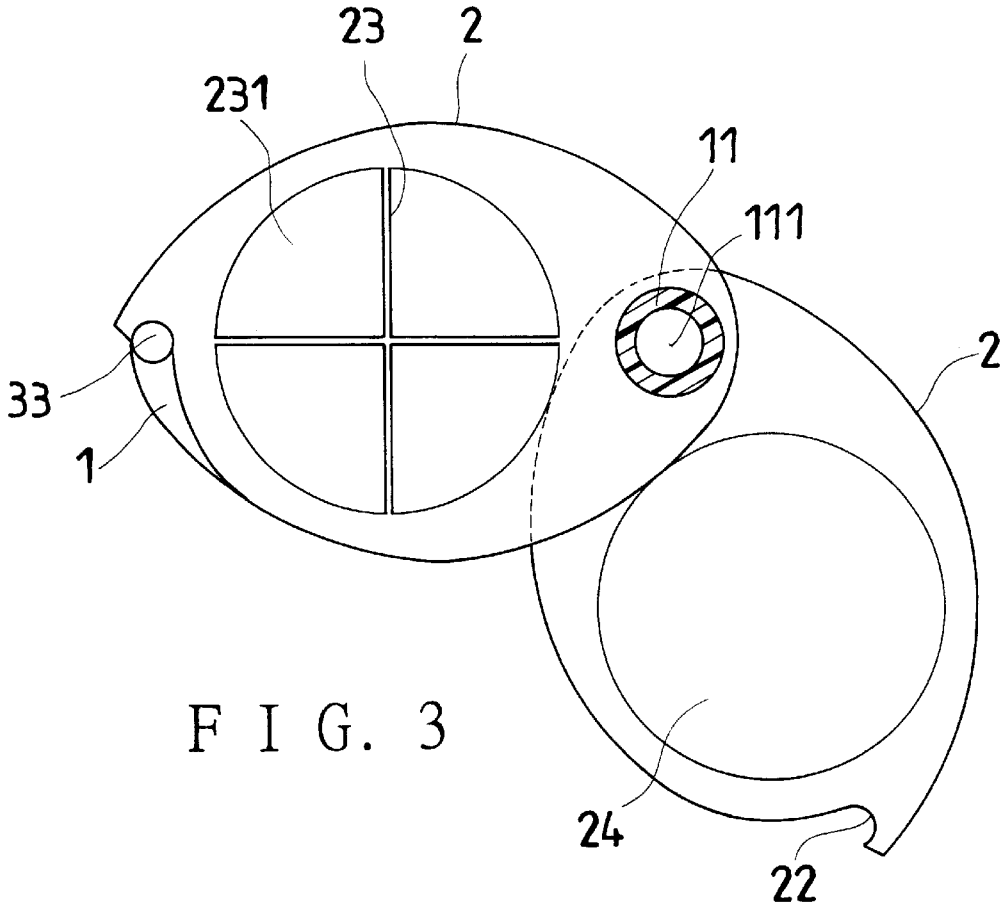
FIG. 3 is an upper view of the cosmetic container of the present invention.

In using the cosmetics stored in the inner container 2, as shown in FIG. 3, push and swing the inner container 2 out of the upper cap 3 with the front post 11 of the lower cap 1 functioning as a pivot. Then the cosmetics stored in the upper portion of the inner container 2 appear and the mirror in the lower portion of the inner container 2 also appears so that a user can select any of the cosmetics stored and looking at the mirror 241 fitted in the recess 24 for proceeding makeup.

Further, a key ring can be fitted through the center through hole 111 of the front post 11 of the lower cap 1, or a band 311 can be made to pass through the same hole 111 for hanging on the neck of a user the cosmetic container with the upper cap 3 having the beautiful pattern or its shape as if hanging a necklace for decoration.

The cosmetic container in the invention has the following advantages, compared with the conventional one mentioned above.

1. Its structure is simple, only consisting of the upper cap, the lower cap and the inner container, easily assembled with no possibility of the components being damaged.
2. The inner container has the upper portion for storing cosmetics, and the lower portion for depositing a mirror, simple to be pushed and swung out of the upper cap for proceeding makeup.
3. The upper cap has a beautiful pattern or a shape of an insect or an animal to have more aesthetic value to excite buying desire of consumers than the conventional one.
4. The center through hole of the front post of the lower cap can be utilized to pass through a key ring for holding keys or for a band to pass through to hang on the neck of a user the cosmetic container as a necklace.
5. The upper portion and the lower portion of the inner container have the concave engage grooves to engage the rear post of the lower cap when not using the cosmetic container, keeping the inner container from falling off the upper and the lower cap.

What is claimed is:

1. A cosmetic container, comprising:

a lower cap having a two-stage front post and a two-stage rear post extending from an upper surface thereof, said two stage front post having a center through hole formed therein, an upper cap having a front through hole receiving an upper stage of said two-stage front post therein, said upper cap having a downwardly extending post aligned with said two-stage rear post of said lower cap and having a rear hole formed therein receiving an upper stage of said two-stage rear post therein; and, an inner container pivotally disposed between said upper and lower caps and having upper and lower portions, said upper portion having a concave groove formed therein and a through hole formed therethrough, said upper portion having a plurality of chambers formed therein, said plurality of chambers being partitioned each from the other by a plurality of separating walls, a lower stage of said front post passing through said through hole of said upper portion to provide a pivotal coupling therebetween, said concave groove of said upper portion releasably engaging said downwardly extending post of said upper cap, said lower portion having a recess, a concave groove and a through hole formed therein, said lower stage of said front post passing through said through hole of said lower portion to provide a pivotal coupling therebetween, said concave groove of said lower portion releasably engaging a lower stage of said two-stage rear post.

2. The cosmetic container as claimed in claim 1, wherein said cosmetic container is formed in a shape of an animal.

3. The cosmetic container as claimed in claim 1, wherein a mirror is received in said recess of said lower portion.

* * * * *